US011377187B2

(12) United States Patent
Blomdahl

(10) Patent No.: US 11,377,187 B2
(45) Date of Patent: Jul. 5, 2022

(54) OUTBOARD MOTOR

(71) Applicant: OXE MARINE AB, Ängelholm (SE)

(72) Inventor: Andreas Blomdahl, Angelholm (SE)

(73) Assignee: OXE MARINE AB, Ängelholm (SE)

( * ) Notice: Subject to any disclaimer, the term of this patent is extended or adjusted under 35 U.S.C. 154(b) by 0 days.

(21) Appl. No.: 17/045,126

(22) PCT Filed: Jun. 28, 2019

(86) PCT No.: PCT/EP2019/067388
§ 371 (c)(1),
(2) Date: Oct. 2, 2020

(87) PCT Pub. No.: WO2020/007742
PCT Pub. Date: Jan. 9, 2020

(65) Prior Publication Data

US 2021/0024192 A1 Jan. 28, 2021

(30) Foreign Application Priority Data

Jul. 5, 2018 (EP) ..... 18181924

(51) Int. Cl.
*B63H 20/14* (2006.01)
*B63H 20/00* (2006.01)

(52) U.S. Cl.
CPC ..... *B63H 20/14* (2013.01); *B63H 2020/006* (2013.01)

(58) Field of Classification Search
CPC ..... B63H 20/14; B63H 21/17; B63H 5/10; B63H 2020/006
See application file for complete search history.

(56) References Cited

U.S. PATENT DOCUMENTS 3,478,620 A 11/1969 Shimanckas
3,788,266 A * 1/1974 Strang ..... F02B 61/045 440/75
4,932,907 A 6/1990 Newman et al.
(Continued)

OTHER PUBLICATIONS

Search Report and Written Opinion for corresponding International Application No. PCT/EP2019/067388 dated Jul. 15, 2019.

*Primary Examiner* — Stephen P Avila
(74) *Attorney, Agent, or Firm* — Renner, Otto, Boisselle & Sklar, LLP

(57) ABSTRACT

An outboard motor comprising a first propeller shaft and a second propeller shaft, wherein the second propeller shaft is arranged concentric with the first propeller shaft, and wherein the first propeller shaft is connected to a first power transfer arrangement to rotate the first propeller shaft in a first direction, and wherein the second propeller shaft is connected to a second power transfer arrangement to rotate the second propeller shaft in a second direction opposite to the first direction. The outboard motor comprises a first electric motor having a first motor shaft, and a second electric motor having a second motor shaft, wherein the first motor shaft is connected to the first power transfer arrangement, and wherein the second motor shaft is connected to the second power transfer arrangement. Disclosed is also a method for driving propeller shafts of an outboard motor.

15 Claims, 9 Drawing Sheets

(56) References Cited

U.S. PATENT DOCUMENTS

Figure 1:
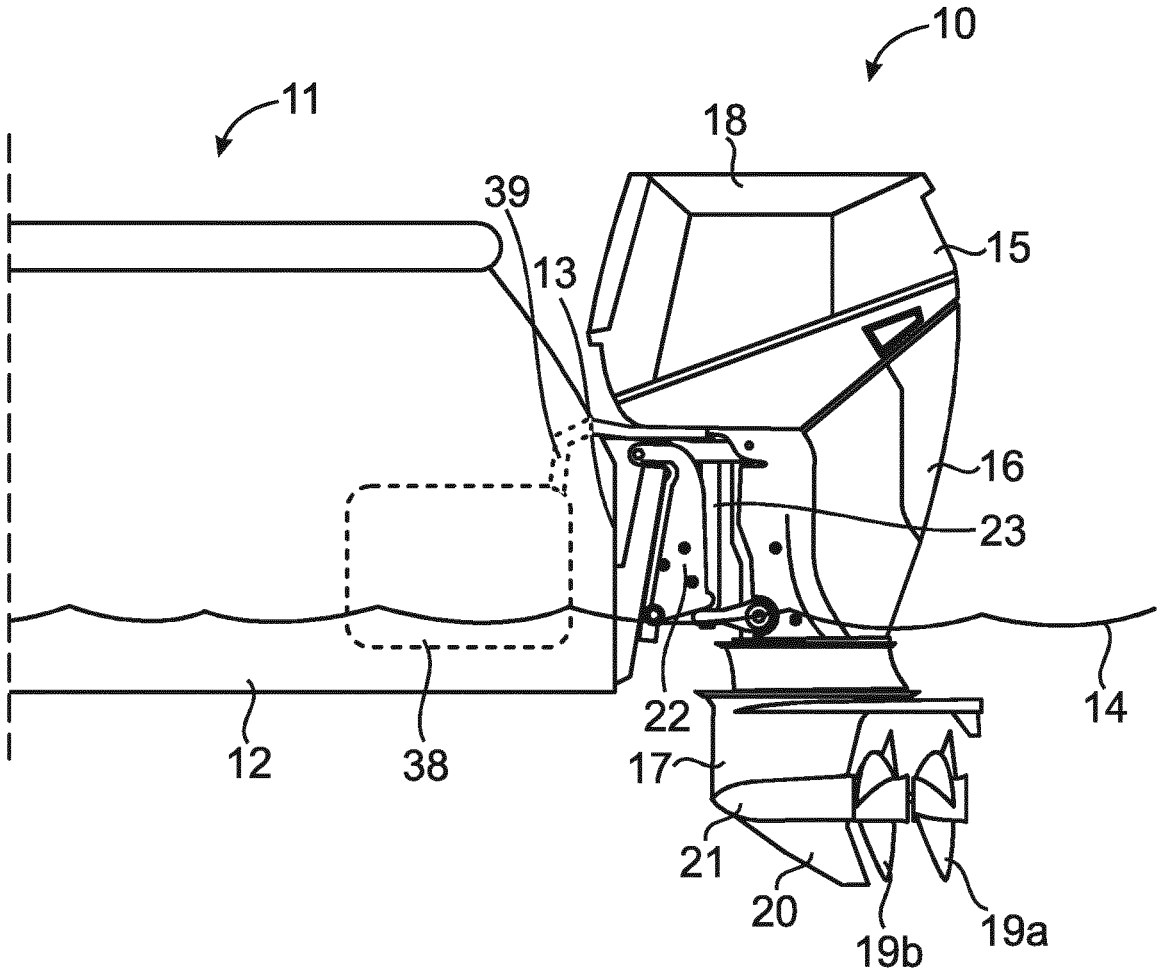

| | | | | |
|---|---|---|---|---|
| 5,009,621 | A * | 4/1991 | Bankstahl | B63H 5/10 416/129 |
| 5,947,779 | A | 9/1999 | Heideman et al. | |
| 2004/0198108 | A1 * | 10/2004 | Levander | B63H 23/04 440/80 |

* cited by examiner

OUTBOARD MOTOR

This application is a national phase of International Application No. PCT/EP2019/067388 filed Jun. 28, 2019 and published in the English language, which claims priority to European Application No. 18181924.4 filed Jul. 5, 2018, both of which are hereby incorporated herein by reference.

FIELD OF THE INVENTION

The present invention relates to an outboard motor. More specifically, the present invention relates to an outboard motor comprising a first power transfer arrangement, such as a first drive shaft, a second power transfer arrangement, such as a second drive shaft, a first propeller shaft and a second propeller shaft, wherein the second propeller shaft is arranged concentric with the first propeller shaft, and wherein the first propeller shaft is connected to the first power transfer arrangement to rotate the first propeller shaft in a first direction, and wherein the second propeller shaft is connected to the second power transfer arrangement to rotate the second propeller shaft in a second direction opposite to the first direction.

Outboard motors are self-contained propulsion and steering devices for watercrafts, such as boats, and are arranged to be fastened to the transom of a boat. One type of such watercrafts is boats that are designed to plane during operation, wherein the propeller shaft is arranged substantially horizontally and below a hull of the watercraft during operation. This type of outboard motors is generally used for driving dual counter-rotating propellers.

The present invention also relates to a watercraft with such an outboard motor. The present invention also relates to a method for driving a propeller shaft of an outboard motor.

PRIOR ART

Outboard motors are common for propulsion of watercrafts, such as boats. They have a powerhead with a motor, a midsection and a lower unit with a propeller shaft for driving a propeller connected to the propeller shaft. A power transfer arrangement is arranged for transferring output power from the motor to the propeller shaft. Further, a mounting bracket for mounting to the transom of the boat is common. A plurality of outboard motors is disclosed in the prior art. However, it is desirable to further improve such outboard motors.

One problem of such prior art outboard motors is that the efficiency is low.

Other problems with such prior art outboard motors are that they can be expensive, bulky or unreliable.

BRIEF DESCRIPTION OF THE INVENTION

One object of the present invention is to provide an efficient and reliable outboard motor. An outboard motor according to the invention can operate in an efficient manner to obtain straight tracking, faster acceleration and a favourable energy consumption.

The present invention relates to an outboard motor comprising a first power transfer arrangement, a second power transfer arrangement, a first propeller shaft and a second propeller shaft, wherein the second propeller shaft is arranged concentric with the first propeller shaft, and wherein the first propeller shaft is connected to the first power transfer arrangement to rotate the first propeller shaft in a first direction, and wherein the second propeller shaft is connected to the second power transfer arrangement to rotate the second propeller shaft in a second direction opposite to the first direction, characterised in that the outboard motor comprises a first electric motor having a first motor shaft, and a second electric motor having a second motor shaft, wherein the first motor shaft is connected to the first power transfer arrangement, and wherein the second motor shaft is connected to the second power transfer arrangement. The outboard motor can include a first propeller connected to the first propeller shaft, and a second propeller connected to the second propeller shaft. Hence, the outboard motor result in an outboard motor having dual counter-rotating propellers. The combination of dual counter-rotating propellers and two electric motors, wherein the first electric motor is for driving the first propeller shaft in one direction and the second electric motor is for driving the second propeller shaft in the opposite direction, result in efficient and reliable marine propulsion. The outboard motor according to the invention results in power transmission in opposite rotational directions in a simple and efficient manner to achieve favourable grip in the water by means of the first and second propellers, which also improves acceleration. Further, the outboard motor results in straight tracking of a watercraft and reduces lateral forces also when a plurality of outboard motors are used on a single watercraft. The first power transfer arrangement can be or comprise a first drive shaft or a first endless loop flexible drive coupling, such as a belt or a chain. The second power transfer arrangement can be or comprise a second drive shaft or a second endless loop flexible drive coupling.

The first motor shaft can be arranged in parallel to the second motor shaft. For example, the first and second motors can be arranged in a standing position, e.g. in a power head of the outboard motor, with the motor shafts directed downwards. Also, the first drive shaft can be arranged in parallel to the second drive shaft. Hence, a simple configuration is achieved for efficient and reliable drive of dual counter-rotating propellers. For example, both motor shafts can be directed vertically downwards, wherein both drive shafts also can be directed vertically downwards for efficient power transfer to the concentric propeller shafts in opposite rotational directions.

The first motor shaft can be offset from the first drive shaft, wherein the axis of rotation of the first motor shaft is displaced radially from the axis of rotation of the first drive shaft. Hence, a radial distance between the drive shafts can be smaller than a radial distance between the motor shafts, so that a favourable configuration and more powerful motors can be fitted in the outboard motor, wherein a smaller outboard motor can be achieved. The first motor shaft can be connected to the first drive shaft through a first power transfer device, such as a connection shaft, cogwheels, an endless loop flexible drive coupling or similar. Also, the second drive shaft can be offset from the second motor shaft in a similar manner.

The drive shafts can be connected to their propeller shaft by means of bevel gears, which can result in a simple configuration and cost-efficient manufacture of the outboard motor.

The present invention is also related to a watercraft, such as a boat, comprising a hull and the outboard motor as disclosed herein. The watercraft can be a planing boat. The outboard motor is arranged for both propelling and steering the watercraft. One or more batteries for supplying power to the electric motors can be arranged within the hull of the watercraft.

Disclosed is also a method for driving propeller shafts of an outboard motor, comprising the steps of a) driving a first motor shaft of a first electric motor in a first direction, and driving a second motor shaft of a second electric motor in a second direction opposite to the first direction, b) transferring rotational power from the first motor shaft to a first power transfer arrangement, and transferring rotational power from the second motor shaft to a second power transfer arrangement, and c) transferring rotational power from the first power transfer arrangement to a first propeller shaft, and transferring rotational power from the second power transfer arrangement to a second propeller shaft arranged concentric to the first propeller shaft, and thereby rotate the first and second propeller shafts in opposite directions.

Further characteristics and advantages of the present invention will become apparent from the description of the embodiments below, the appended drawings and the dependent claims.

SHORT DESCRIPTION OF THE DRAWINGS

Figure 2:
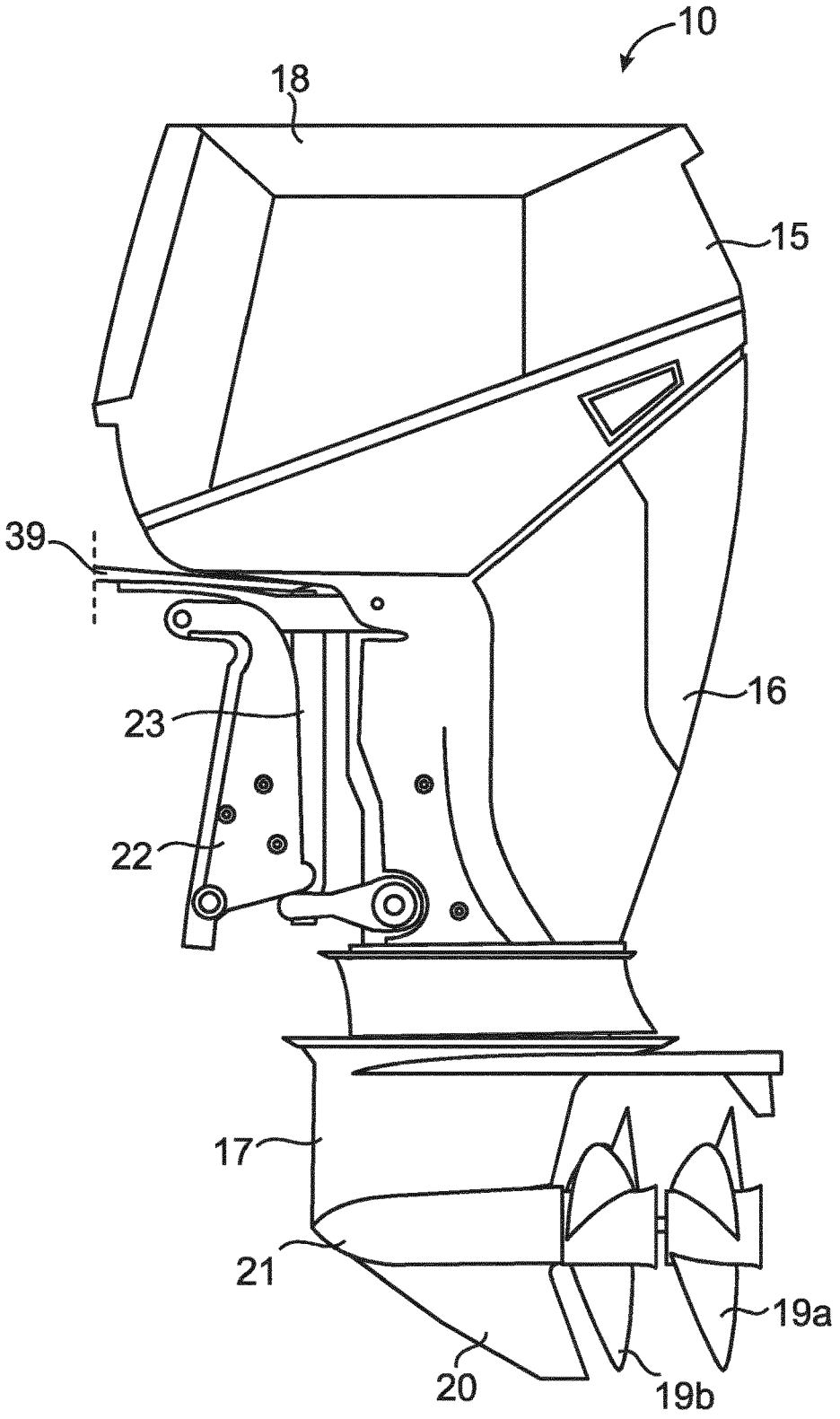
Figure 3:
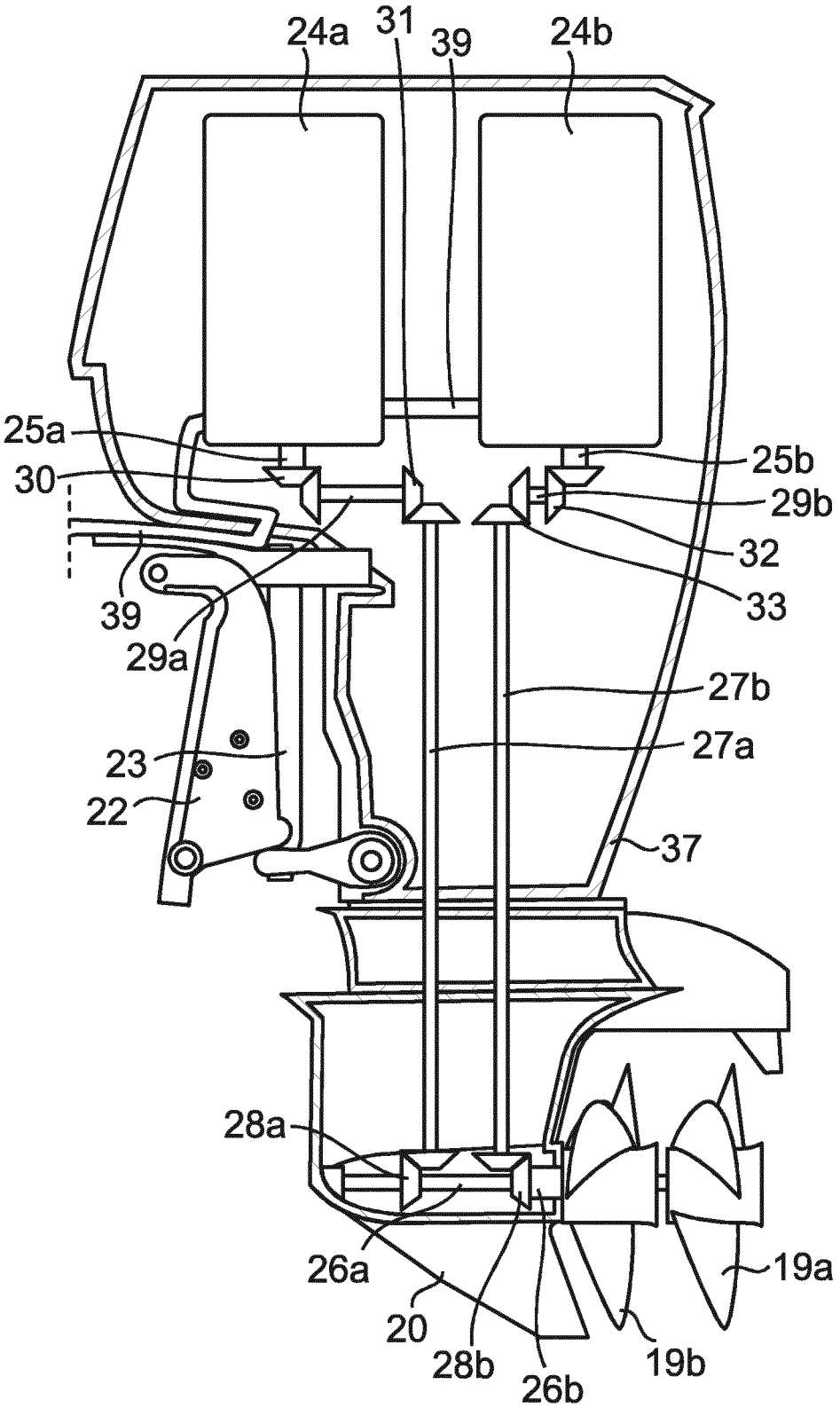
Figure 4:
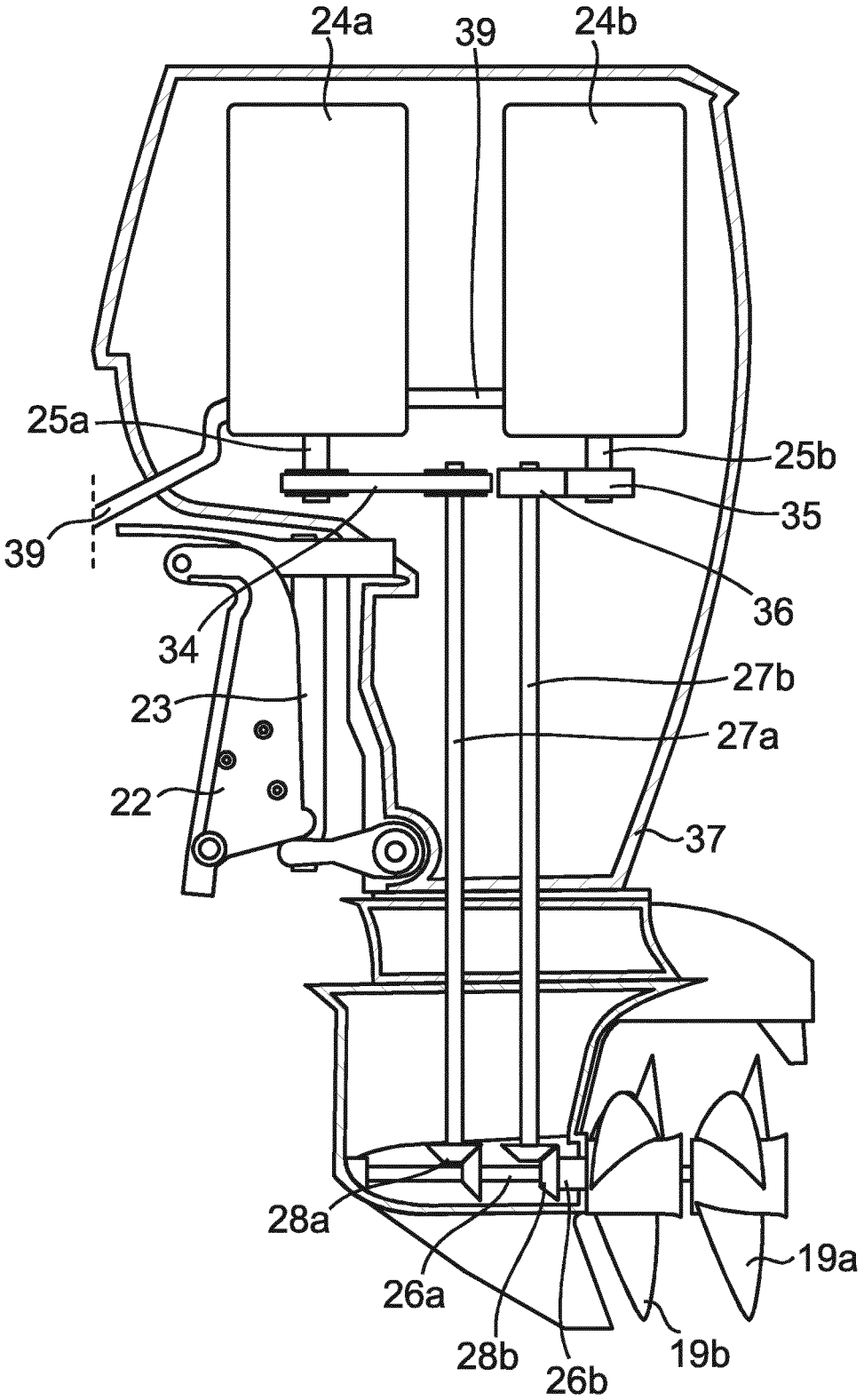
Figure 5:
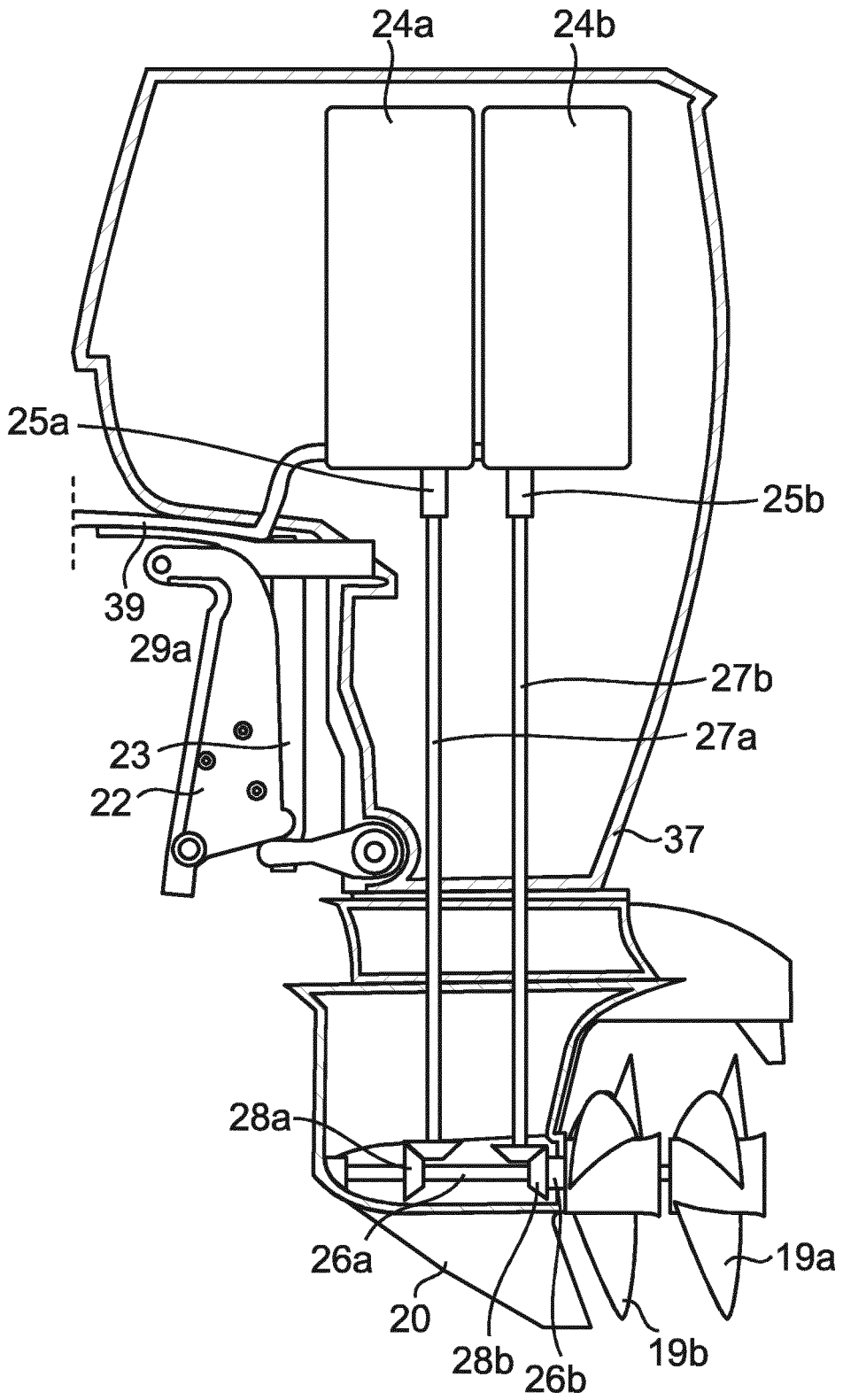
Figure 6:
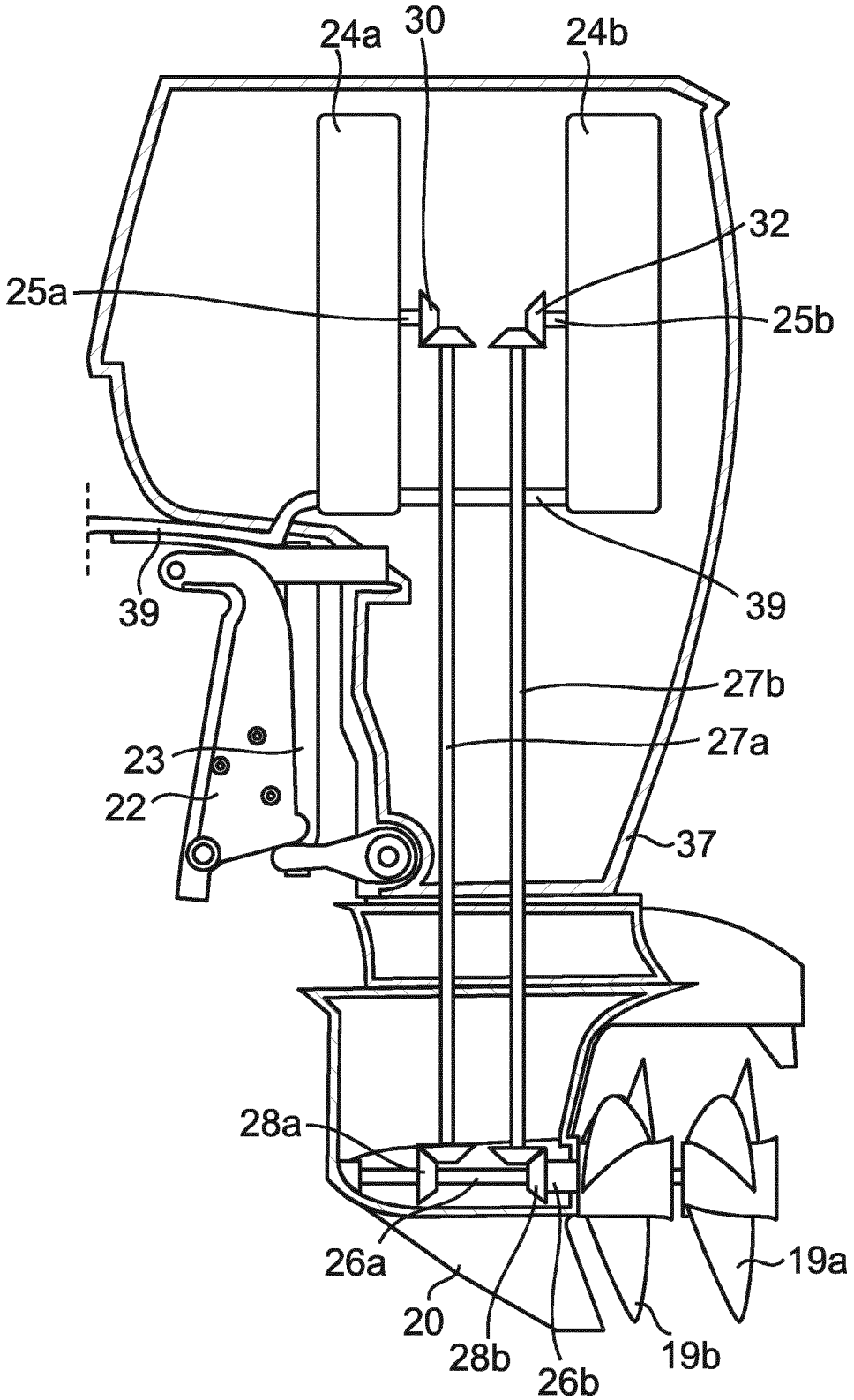
Figure 7:
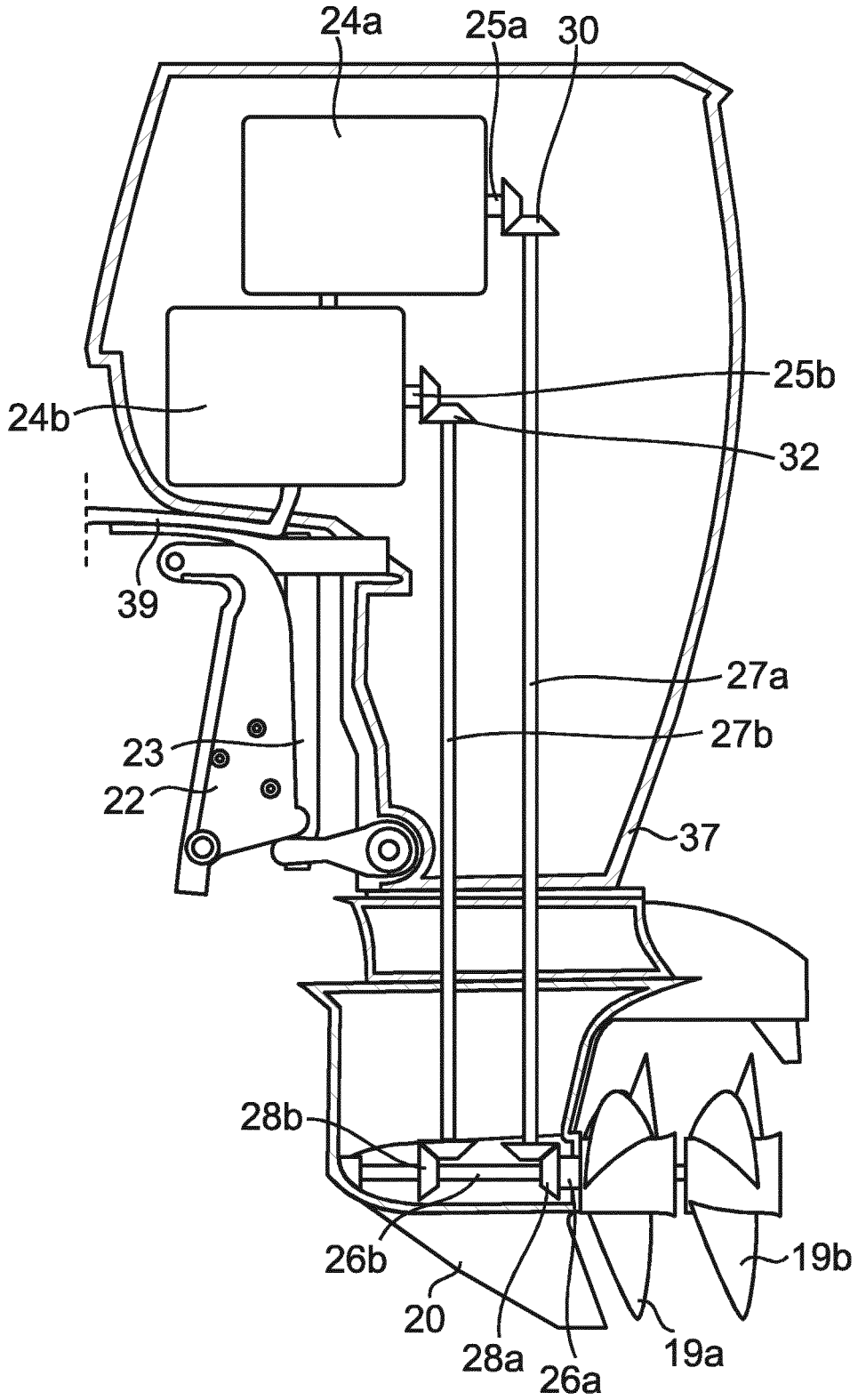
Figure 8:
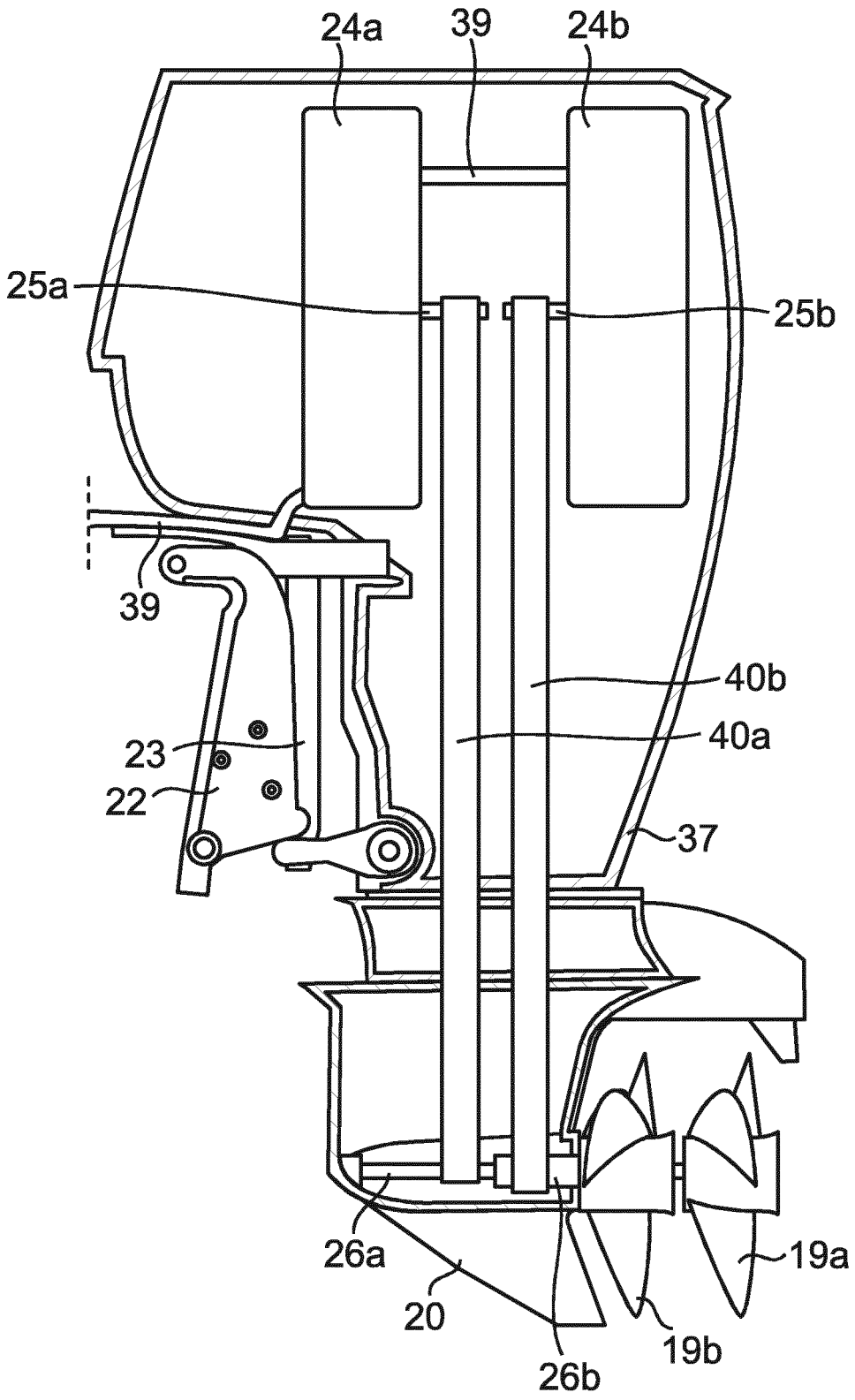
Figure 9:
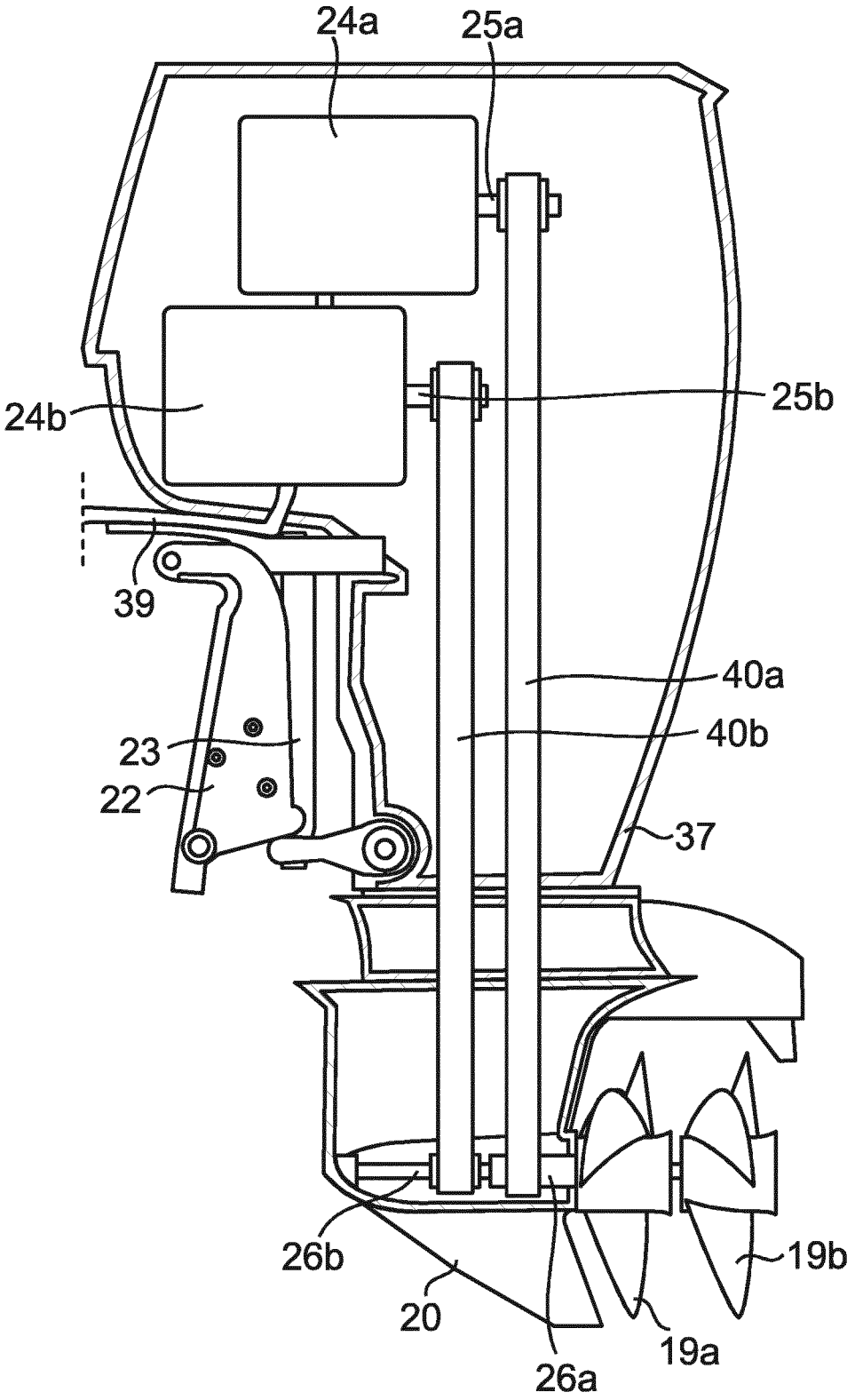

The invention will now be described in more detail with the aid of exemplary embodiments and with reference to the accompanying drawings, in which FIG. 1 is a schematic side view of a part of a watercraft with an outboard motor according to one embodiment, FIG. 2 is a schematic side view of the outboard motor of FIG. 1, FIG. 3 is a schematic and partial section view of the outboard motor, wherein an engine housing and a drive housing are illustrated in section to disclose a first electric motor and a second electric motor and a power transfer arrangement according to one embodiment, wherein the electric motors are in a standing position, FIG. 4 is a schematic and partial section view of the outboard motor, wherein the engine housing and the drive housing are illustrated in section to disclose the electric motors and the power transfer arrangement according to another embodiment, wherein the electric motors are in a standing position, FIG. 5 is a schematic and partial section view of the outboard motor, wherein the engine housing and the drive housing are illustrated in section to disclose the electric motors and the power transfer arrangement according to yet another embodiment, wherein the electric motors are in a standing position, FIG. 6 is a schematic and partial section view of the outboard motor, wherein the engine housing and the drive housing are illustrated in section to disclose the electric motors and the power transfer arrangement according to an alternative embodiment, wherein the electric motors are in a lying position, FIG. 7 is a schematic and partial section view of the outboard motor, wherein the engine housing and the drive housing are illustrated in section to disclose the electric motors and the power transfer arrangement according to yet another embodiment, wherein the electric motors are in a lying position, FIG. 8 is a schematic and partial section view of the outboard motor, wherein the engine housing and the drive housing are illustrated in section to disclose the electric motors and the power transfer arrangement according to yet another embodiment, wherein the electric motors are in a lying position, FIG. 9 is a schematic and partial section view of the outboard motor, wherein the engine housing and the drive housing are illustrated in section to disclose the electric motors and the power transfer arrangement according to yet another embodiment, wherein the electric motors are in a lying position.

THE INVENTION

With reference to FIG. 1 an outboard motor 10 for a watercraft 11, such as a boat, is illustrated according to one embodiment of the invention. The outboard motor 10 is a self-contained marine propulsion and steering device for propulsion and steering of the watercraft 11. In FIG. 1 a rear part of the watercraft 11 is illustrated. The watercraft 11 comprises a hull 12 and a transom 13. For example, a lower part of the hull 12 is arranged to be below a waterline 14 when the watercraft 11 is in water and the watercraft 11 not is propelled, wherein an upper part of the hull is arranged to be above the waterline 14. For example, the watercraft 11 is arranged to plane during operation at higher speed, wherein the hull 12 is arranged with a planing hull form.

With reference also to FIG. 2 the outboard motor 10 comprises a power head 15, a midsection 16 and a lower unit 17. The power head 15 includes a motor housing 18, such as a cowling. The lower unit 17 includes a first propeller 19*a* and a second propeller 19*b*. For example, the lower unit 17 also includes a skeg 20 and other conventional parts, such as a torpedo-shaped part 21. The midsection 16 is formed as a leg connecting the power head 15 and the lower unit 17. Hence, the outboard motor 10 is arranged to be connected to the hull 12 of the watercraft 11, so that the outboard motor 10, or at least a major part thereof, is arranged outside the hull 12. The midsection 16 is arranged outside the transom 13 and the lower unit 17 with the propellers 19*a*, 19*b* is arranged outside and below the hull 12. When the outboard motor 10 is operated the propellers 19*a*, 19*b* are arranged below the water line 14 and also below the hull 12. For example, the lower unit 17 is arranged below the hull 12 during normal operation of the outboard motor 10. Hence, the outboard motor 10 is arranged to project a distance into the water when operated, so that the propellers 19*a*, 19*b*, the lower unit 17 and optionally a part of the midsection 16 are immersed in the water, so that the water line 14 is arranged above the propellers 19*a*, 19*b* and above the lower unit 17. Hence, the lower unit 17 is formed for efficient hydrodynamics. For example, the outboard 10 is arranged for a planing watercraft 11. The propellers 19*a*, 19*b* are arranged for counter-rotating, wherein the propellers 19*a*, 19 *b* are arranged to rotate in opposite directions in relation to each other for propelling the watercraft. Hence, one of the first and second propellers 19*a*, 19*b* is a right-handed propeller, which rotates clockwise as viewed from the stern when propelling the watercraft forward, wherein the other is a left-handed propeller, which rotates counter-clockwise as viewed from the stern when propelling the watercraft 11 forward.

For example, the outboard motor 10 comprises conventional fastening means for fastening the outboard motor 10 to the stern of the hull 12, such as the transom 13. The fastening means is, for example, arranged as a conventional mounting bracket 22. For example, the mounting bracket 22 comprises or is provided with a trim/tilt system, such as a hydraulic or electric trim/tilt system. For example, the trim/tilt system is conventional. Hence, the outboard motor 10 comprises a laterally extending trim axis, such as a horizontal trim axis. The outboard motor 10 comprises a steering axis 23, such as a vertical or substantially vertical steering axis (depending on trim). The entire outboard motor 10, except for the mounting bracket 22, is turned around the steering axis 23 for steering the watercraft 11. Hence, the power head 15, the midsection 16 and the lower unit 17 are pivotable around the steering axis 23. For example, the power head 15, the midsection 16 and the lower unit 17 are arranged in fixed positions in relation to each other and are turned as one unit around the steering axis 23.

With reference to FIG. 3 the outboard motor 10 according to one embodiment is illustrated schematically in section so as to disclose schematically some of the parts arranged therein. As illustrated in FIG. 3 the outboard motor 10 comprises a first electric motor 24*a*, a second electric motor 24*b*, the first and second propellers 19*a*, 19*b* and power transmission arrangements for transferring output power originating from the motors 24*a*, 24*b* to the propellers 19*a*, 19*b*.

The electric motors 24*a*, 24*b* comprise a motor shaft 25*a*, 25*b* for output power in the form of rotational power, also called torque herein. Hence, the first electric motor 24*a* has a first motor shaft 25*a*, wherein the second electric motor 25*b* has a second motor shaft 25*b*. For example, the electric motors 24*a*, 24*b* comprise, e.g. a stator and a rotor. For example, the electric motors 24*a*, 24*b* are AC electric motors, such as asynchronous motors. For example, the electric motors 24*a*, 24*b* are induction motors. Alternatively, the electric motors 24*a*, 24*b* are DC motors, such as brushed DC electric motors, permanent magnet DC motors, or brushless DC motors. The outboard motor 10 of the present invention can handle a variety of output powers and can be arranged smaller or bigger as desired within reasonable limitations, such as weight and volume suitable for outboard motors 10 and taking hydrodynamics into consideration. However, the outboard motor 10 according to the described structure can handle a variety of torques and still be hydrodynamic and efficient for use as an outboard motor 10. For example, each of the electric motors 24*a*, 25 is able to develop at least 15 kW. For example, each of the electric motors 24*a*, 25 is able to develop at least 50 kW or at least 75 kW, such as 100 kW or 200 kW. For example, the electric motors 24*a*, 24*b* are conventional industrially produced electric motors, such as mass produced in series of at least thousands. The motors 24*a*, 25*b* are, e.g. mounted on motor support structures, which are not illustrated in the drawings. According to one embodiment, the outboard motor 10 comprises two similar electric motors 24*a*, 24*b*. Alternatively, the outboard motor 10 comprises two different electric motors 24*a*, 24*b*. For example, the first electric motor 24*a* is arranged for rotating the first motor shaft 25*a* in a first direction, such as clockwise, wherein the second electric motor 24*b* is arranged for rotating the second motor shaft 25*b* in a second direction opposite to the first direction, such as counter-clockwise. For example, the electric motors 24*a*, 24*b* are reversible, so that the motor shafts 25*a*, 25*b* can be driven in any rotational direction. For example, the speed of the electric motors 24*a*, 24*b* is adjustable, so that the motor shafts 25*a*, 25*b* can be driven in a selectable rotational speed. For example, the speed and rotational direction of the electric motors 24*a*, 24*b* are controlled by conventional control means, which is not illustrated in the drawings.

In the embodiment of FIG. 3 the electric motors 24*a*, 24*b* are arranged in standing position, wherein the motor shafts 25*a*, 25*b* extend substantially downward when the outboard motor 10 is operated. Hence, the motor shafts 25*a*, 25 extend substantially vertically. In the illustrated embodiment, the first and second motor shafts 25*a*, 25*b* are arranged in parallel. The first motor shaft 25*a* has a first axis of rotation extending along the first motor shaft 25*a*, wherein the second motor shaft 25*b* has a second axis of rotation extending along the second motor shaft 25*b*. In the illustrated embodiment, the first electric motor 24*a* is arranged at the same level as the second electric motor 24*b*, so that upper and/or lower surfaces of the electric motors 24*a*, 24*b* are arranged in a common plane. Alternatively, the first and second electric motors 24*a*, 24*b* are displaced in relation to the other, so that the upper and/or lower surfaces of one of the electric motors 24*a*, 24*b* is/are displaced in a direction along the motor shafts 25*a*, 25*b* in relation to the upper and/or lower surfaces of the other of the electric motors 24*a*, 24*b*.

The outboard motor 10 comprises a first propeller shaft 26*a* and a second propeller shaft 26*b*. The first propeller shaft 26*a* is arranged for driving the first propeller 19*a*. Hence, the first propeller 19*a* is connected to or connectable to the first propeller shaft 26*a*. The second propeller shaft 26*b* is arranged for driving the second propeller 19*b*. Hence, the second propeller 19*b* is connected to or connectable to the second propeller shaft 26*b*. For example, the outboard motor 10 comprises the first and second propellers 19*a*, 19*b* in the form of dual counter-rotating propellers, wherein the first and second propellers 19*a*, 19*b* are arranged to rotate in opposite directions. For example, the first propeller 19*a* is arranged to rotate in a clockwise direction, wherein the second propeller 19*b* is arranged to rotate in a counter-clockwise direction, or vice versa, to propel the watercraft 11 forward. The first and second propeller shafts 26*a*, 26*b* are arranged in the form of dual propeller shafts. The first and second propeller shafts 26*a*, 26*b* are concentric and arranged to rotate in opposite directions to rotate the first and second propellers 19*a*, 19*b* in opposite directions. In the embodiment of FIG. 3 the first propeller shaft 26*a* extends through the second propeller shaft 26*b* and through the second propeller 19*b* to the first propeller 19*a*. Hence, the first propeller shaft 26*a* is arranged with smaller diameter than the second propeller shaft 26*b*. Further, the first propeller shaft 26*a* is longer than the second propeller shaft 26*b*. The propeller shafts 26*a*, 26*b* are arranged in the torpedo-shaped part 21 of the lower unit 17. In the embodiment of FIG. 3 the propeller shafts 26*a*, 26*b* are arranged perpendicular to the motor shafts 25*a*, 25*b*.

The outboard motor 10 comprises a first power transfer arrangement for transferring output power from the first motor shaft 25*a* to the first propeller shaft 26*a*, and a second power transfer arrangement for transferring output power from the second motor shaft 25*b* to the second propeller shaft 26*b*. For example, the first power transfer arrangement is arranged separately from the second power transfer arrangement, wherein the power from the first motor shaft 25*a* is only transferred to the first propeller shaft 26*a* and wherein the power from the second motor shaft 25*b* is only transferred to the second propeller shaft 26*b*. In the embodiment of FIG. 3, the first power transfer arrangement includes a first drive shaft 27*a*, and the second power transfer arrangement includes a second drive shaft 27*b*. The first propeller shaft 26*a* is connected to the first motor shaft 24*a* through the first drive shaft 27*a* to rotate the first propeller shaft 26*a*. Hence, the first drive shaft 27*a* has an axis of rotation. For example, the first propeller shaft 26*a* is connected to the first motor shaft 24*a* through the first drive shaft 27*a* to rotate the first propeller shaft 26*a* in a first direction, such as clockwise, for propelling the watercraft 11 in a forward direction. The second propeller shaft 26*b* is connected to the second motor shaft 24*b* through the second drive shaft 27*b* to rotate the second propeller shaft 26*b*. Hence, the second drive shaft 27*b* has an axis of rotation. For example, the second propeller shaft 26*b* is connected to the second motor shaft 24*b* through the second drive shaft 27*b* to rotate the second propeller shaft 26*b* in a second direction opposite to the first direction, such as counter-clockwise, for propelling the watercraft 11 in a forward direction. In the embodiment of FIG. 3 the first power transfer arrangement includes the first drive shaft 27*a* and any other elements for transferring output power from the first motor shaft 25*a* to the first propeller shaft 26*a*, wherein the second power transfer arrangement includes the second drive shaft 27*b* and any other elements for transferring output power from the second motor shaft 25*b* to the second propeller shaft 26*b*. In the illustrated embodiment, the first power transfer arrangement is arranged separately from the second power transfer arrangement, so that the first propeller shaft 26*a* is driven by means of only the first electric motor 24*a*, and the second propeller shaft 26*b* is driven by means of only the second electric motor 24*b*.

In the illustrated embodiment, the drive shafts 27*a*, 27*b* extend perpendicular to the propeller shafts 26*a*, 26*b*. For example, the drive shafts 27*a*, 27*b* extend in parallel to the motor shafts 25*a*, 25*b* and, e.g. substantially vertically when the outboard motor 10 is operated. According to the illustrated embodiment, the drive shafts 27*a*, 27*b* extend from the power head 15, through the midsection 16 and into the lower unit 17 of the outboard motor 10. In the embodiment of FIG. 3 the axis of rotation of the first drive shaft 27*a* is displaced to the axis of rotation of the first motor shaft 25*a*. Hence, the first drive shaft 27*a* is offset in relation to the first motor shaft 25*a*, so that they are not aligned and not coaxial. For example, the first drive shaft 27*a* is arranged in parallel to the first motor shaft 25*a*. In the illustrated embodiment, also the axis of rotation of the second drive shaft 27*b* is displaced to the axis of rotation of the second motor shaft 25*b*. Hence, the second drive shaft 27*b* is offset in relation to the second motor shaft 25*b*, so that they are not aligned and not coaxial. For example, the second drive shaft 27*b* is arranged in parallel to the second motor shaft 25*b*. Hence, at least one of the drive shafts 27*a*, 27*b* is displaced in relation to the motor shaft 25*a*, 25*b* it is connected to, so that a distance between the drive shafts 27*a*, 27*b*, i.e. a distance between the axes of rotation thereof, is smaller than a distance between the motor shafts 25*a*, 25*b*, i.e. a distance between the axes of rotation thereof.

In the illustrated embodiment, the first drive shaft 27*a* is connected to the first propeller shaft 25*a* through a first bevel gear 28*a* for transferring output power from the first drive shaft 27*a* to the first propeller shaft 26*a*, wherein the second drive shaft 27*b* is connected to the second propeller shaft 26*b* through a second bevel gear 28*b* for transferring output power from the second drive shaft 27*b* to the second propeller shaft 26*b*.

In the embodiment of FIG. 3 the first motor shaft 25*a* is connected to the first drive shaft 27*a* through first power transfer device in the form of a first connection shaft 29*a* and bevel gears 30, 31. The first connection shaft 29*a* is arranged perpendicular to the first motor shaft 25*a* and to the first drive shaft 27*a*. For example, the first connection shaft 29*a* extends in the fore-aft direction, such as substantially horizontally in a longitudinal direction of the watercraft 11 when the outboard motor 10 is operated. For example, the second motor shaft 25*b* is connected to the second drive shaft 27*b* through a second power transfer device in the form of a second connection shaft 29*b* and bevel gears 32, 33 in a similar manner. In the illustrated embodiment, the first and second connection shafts 29*a*, 29*b* are arranged with different lengths. Alternatively, the first and second connection shafts 29*a*, 29*b* are arranged with similar lengths. In the illustrated embodiment, the first and second connection shafts 29*a*, 29*b* are arranged at the same level, such as in a common plane perpendicular to the drive shafts 27*a*, 27*b*. For example, the first and second connection shafts 29*a*, 29*b* are coaxial, optionally with a gap between them. Alternatively, axis of rotation of the first and second connection shafts 29*a*, 29*b* are displaced in relation to each other. For example, one of the first and second connection shafts 29*a*, 29*b* is arranged below the other.

With reference to FIG. 4 an alternative embodiment is illustrated, wherein the first motor shaft 25*a* is connected to the first drive shaft 27*a* through the first power transfer device in the form of an endless loop flexible drive coupling 34, such as a belt or a chain. For example, the endless loop flexible drive coupling 34 is a toothed belt interacting with corresponding teeth on the first motor shaft 25*a* and the first drive shaft 27*a* or pulleys arranged thereon. Hence, the first drive shaft 27*a* is displaced in relation to the first motor shaft 25*a* as described above to reduce the distance between the first and second drive shafts 27*a*, 27*b* in relation to the distance between the first and second motor shafts 25*a*, 25*b*. Hence, the endless loop flexible drive coupling 34 extends in a direction perpendicular to the first motor shaft 25*a* and to the first drive shaft 27*a*. For example, the endless loop flexible drive coupling 34 is arranged substantially horizontally when the outboard motor 10 is operated.

For example, the second drive shaft 27*b* is displaced in relation to the second motor shaft 25*b* in a similar manner by means of the second power transfer device. In the embodiment of FIG. 4, the second motor shaft 25*b* is connected to the second drive shaft 27*b* through the second power transfer device in the form of at least first and second cogwheels 35, 36. For example, the cogwheels 35, 36 are arranged substantially horizontally when the outboard motor 10 is operated. Alternatively, the second motor shaft 25*b* is connected to the second drive shaft 27*b* through an endless loop flexible drive coupling. According to alternative embodiments, the first motor shaft 25*a* is connected to the first drive shaft 27*a* through the first connection shaft 29*a*, the endless loop flexible drive coupling 34 or cogwheels, wherein the second motor shaft 25*b* is connected to the first second shaft 27*b* through the second connection shaft 29*b*, an endless loop flexible drive coupling or cogwheels. Hence, the first power transfer device is arranged for connecting the first motor shaft 25*a* and the first drive shaft 27*a* for transferring torque from the first motor shaft 25*a* to the first drive shaft 27*a*. For example, the first power transfer device is arranged to transfer toque only from the first motor shaft 25*a* to the first drive shaft 27*a*. The first power transfer device is, e.g. the first connection shaft 29*a*, the endless loop flexible drive coupling 34, a plurality of cogwheels or similar power transfer device. The second power transfer device is arranged for connecting the second motor shaft 25*b* and the second drive shaft 27*b* for transferring torque from the second motor shaft 25*b* to the second drive shaft 27*b*. For example, the second power transfer device is arranged to transfer toque only from the second motor shaft 25*b* to the second drive shaft 27*b*. The second power transfer device is, e.g. the second connection shaft 29*b*, an endless loop flexible drive coupling, a the two or more cogwheels 35, 36 or similar power transfer device.

For example, the first and second drive shafts 27*a*, 27*b* are arranged in parallel or substantially in parallel. In the illustrated embodiment the first and second drive shafts 27*a*, 27*b* extend along the midsection 16 and into the lower unit 17, wherein the first and second drive shafts 27*a*, 27*b* extend vertically or substantially vertically when the outboard motor 10 is operated (depending on trim) to transfer power in the same direction. The drive shafts 27*a*, 27*b* connect the motor shafts 25*a*, 25*b* and the propeller shafts 26*a*, 26*b*, optionally through the connection shafts 29*a*, 29*b*, endless loop flexible drive couplings or cogwheels, and transfers rotational power from the drive shafts 27*a*, 27*b* to the propeller shafts 26*a*, 26*b*, e.g. through the bevel gears 28*a*, 28*b*. In the embodiment of FIGS. 3 and 4 the first drive shaft 27*a* is substantially equal in length as the second drive shaft 27*b*. Alternatively, the first drive shaft 27*a* is longer than the second drive shaft 27*b*. In the illustrated embodiment the first and second drive shafts 27*a*, 27*b* are arranged below the motors 24*a*, 24*b*.

For example, the connection shafts 29*a*, 29*b* and the propeller shafts 26*a*, 26*b* are arranged in parallel or substantially in parallel. For example, the propeller shafts 26*a*, 26*b*, the drive shafts 27*a*, 27*b*, the connection shafts 29*a*, 29*b* and the motor shafts 25*a*, 25*b* are arranged in a common plane, such as a common vertical plane when the outboard motor 10 is mounted on the watercraft 11. For example, the connection shafts 29*a*, 29*b* and the propeller shafts 26*a*, 26*b* are arranged horizontally or substantially horizontally when the outboard motor 10 is in a non-tilted operational position for propelling the watercraft 11 and the trim is neutral, wherein the motor shafts 25*a*, 25*b* and the drive shafts 27*a*, 27*b* are arranged vertically or substantially vertically.

According to one embodiment the outboard motor 10 does not comprise any clutch. For example, the outboard motor 10 does not comprise any gearbox for reversing the rotational direction of the output power. For example, the electric motors 24*a*, 24*b* are arranged for allowing seamless control from zero to maximum rpm of the output power of the motor shafts 25*a*, 25*b* in any of the selected clockwise or counter-clockwise rotational direction. For example, the output power from the electric motors 24*a*, 24*b* is reversible, such as fully reversible, wherein the propellers 19*a*, 19*b* can be driven in a forward mode as well as a reverse mode by the electric motors 24*a*, 24*b*. Hence, the rotational power from the electric motors 24*a*, 24*b* can be transferred to the propeller shafts 26*a*, 26*b* in either rotational direction for full motor power forward or full motor power in reverse.

The outboard motor 10 comprises a drive housing 37 and the motor housing 18 for receiving the electric motors 24*a*, 24*b*, the drive shafts 27*a*, 27*b*, the bevel gears 28*a*, 28*b* and the propeller shafts 26*a*, 26*b* and optionally also the connection shafts 29*a*, 29*b*. The drive housing 37 and the motor housing 18 provides functions of structural support, spacing and enclosing for other components of the outboard motor 10, such as the electric motors 24*a*, 24*b*, the drive shafts 27*a*, 27*b*, the bevel gears 28*a*, 28*b* and the propeller shafts 26*a*, 26*b* and optionally also the connection shafts 29*a*, 29*b*, and also supports the propellers 19*a*, 19*b* through the propeller shafts 26*a*, 26*b* being supported by the drive housing 37. For example, the drive housing 37 extends from the motor housing 18 to the skeg 20. According to one embodiment of the invention the drive housing 37 is formed with a water inlet or a water pickup for cooling. The drive housing 37 is, for example, formed in a composite material or any other suitable material. The propeller shafts 26*a*, 26*b* are positioned partially in the drive housing 37, wherein outer portions thereof project out from the drive housing 37 for carrying the propellers 19*a*, 19*b*.

The first and second electric motors 24*a*, 24*b* are connected to a battery 38, which is illustrated schematically by means of dashed lines in FIG. 1. For example, both of the first and second electric motors 24*a*, 24*b* are connected to a single battery 38. Alternatively, the first electric motor 24*a* is connected to a first battery dedicated to provide power to only the first electric motor 24*a*, wherein the second electric motor 24*b* is connected to a second battery dedicated to provide power only to the second electric motor 24*b*. The battery 38 is arranged outside the outboard motor 10. In the illustrated embodiment, the battery 38 is arranged on the watercraft 11. Hence, the watercraft 11 comprises a battery compartment, e.g. in the hull 12 or within the hull 12. The electric motors 24*a*, 24*b* are, e.g. connected to the battery 38 through a cable 39 extending between the outboard motor 10 and the battery 38. Alternatively, the first electric motor 24*a* is connected to the battery 38 or a first battery through a first cable, wherein the second electric motor 24*b* is connected to the battery 38 or a second battery through a second cable.

With reference to FIG. 5 another embodiment is illustrated, wherein the first and second motors 24*a*, 24*b* are in standing positions and the first motor shaft 25*a* is directly connected to the first drive shaft 27*a* and the second motor shaft 25*b* is directly connected to the second drive shaft 27*b*. Hence, the first drive shaft 27*a* is aligned to and coaxial to the first motor shaft 25*a*, wherein the second drive shaft 27*b* is aligned to and coaxial to the second motor shaft 25*b*. The motor shafts 24*a*, 24*b* and the drive shafts 27*a*, 27*b* are arranged substantially vertically when the outboard motor 10 is operated.

For example, the first and second drive shafts 27*a*, 27*b* are arranged in parallel or substantially in parallel. In the illustrated embodiment the first and second drive shafts 27*a*, 27*b* extend along the midsection 16 and into the lower unit 17, wherein the first and second drive shafts 27*a*, 27*b* extend vertically or substantially vertically when the outboard motor 10 is operated (depending on trim) to transfer power in the same direction. The drive shafts 27*a*, 27*b* connect the motor shafts 25*a*, 25*b* and the propeller shafts 26*a*, 26*b*, and transfers rotational power from the motor shafts 25*a*, 25*b* to the propeller shafts 26*a*, 26*b*, e.g. through the bevel gears 28*a*, 28*b*. For example, the propeller shafts 26*a*, 26*b* are arranged horizontally or substantially horizontally when the outboard motor 10 is in a non-tilted operational position for propelling the watercraft 11 and the trim is neutral, wherein the motor shafts 25*a*, 25*b* and the drive shafts 27*a*, 27*b* are arranged vertically or substantially vertically.

With reference to FIG. 6 an alternative embodiment is illustrated, wherein the first and second motors 24*a*, 24*b* are in lying positions and the first motor shaft 25*a* is connected to the first drive shaft 27*a* through the bevel gears 30 and the second motor shaft 25*b* is connected to the second drive shaft 27*b* through the bevel gears 32. Hence, the first drive shaft 27*a* is perpendicular to the first motor shaft 25*a*, wherein the second drive shaft 27*b* is perpendicular to the second motor shaft 25*b*. The motor shafts 24*a*, 24*b* are arranged substantially horizontally and the drive shafts 27*a*, 27*b* are arranged substantially vertically when the outboard motor 10 is operated.

In the embodiment of FIG. 6, the first and second motor shafts 25*a*, 25*b* are extending toward each other. For example, the first motor shaft 25*a* extends aftward while the second motor shaft 25*b* extends forward. In the illustrated embodiment, the first and second motor shafts 25*a*, 25*b* are aligned and coaxial, e.g. with a gap or bearing between them. The first and second drive shafts 27*a*, 27*b* are arranged in parallel or substantially in parallel and extend vertically or substantially vertically when the outboard motor 10 is operated. The drive shafts 27*a*, 27*b* connect the motor shafts

25*a*, 25*b* and the propeller shafts 26*a*, 26*b*, and transfers rotational power from the motor shafts 25*a*, 25*b* to the propeller shafts 26*a*, 26*b*, e.g. through the bevel gears 28*a*, 28*b*. In the embodiment of FIG. 6 the first and second motor shafts 25*a*, 25*b* are arranged in parallel to the propeller shafts 26*a*, 26*b*.

With reference to FIG. 7 another alternative embodiment is illustrated, wherein the first and second motors 24*a*, 24*b* are in lying positions and the first motor shaft 25*a* is connected to the first drive shaft 27*a* through the bevel gears 30 and the second motor shaft 25*b* is connected to the second drive shaft 27*b* through the bevel gears 32. Hence, the first drive shaft 27*a* is perpendicular to the first motor shaft 25*a*, wherein the second drive shaft 27*b* is perpendicular to the second motor shaft 25*b*. The motor shafts 24*a*, 24*b* are arranged substantially horizontally and the drive shafts 27*a*, 27*b* are arranged substantially vertically when the outboard motor 10 is operated.

In the embodiment of FIG. 7, the first and second motor shafts 25*a*, 25*b* are arranged in parallel and extend in the same direction, such as aftward. For example, the first motor 24*a* is displaced vertically in relation to the second motor 24*b*, wherein the first motor 24*a* is arranged above the second motor 24*b*. Hence, in the embodiment of FIG. 7 the first drive shaft 27*a* is longer then the second drive shaft 27*b*. In the illustrated embodiment, the first motor 24*a* is displaced also aftward in relation to the second motor 24*b*. Alternatively, the first motor 24*a* is arranged straight above the second motor 24*b*, wherein the first motor shaft 25*a* is longer than the second motor shaft 25*b* or extended in another suitable manner, such as by a power transfer device. The first and second drive shafts 27*a*, 27*b* are arranged in parallel or substantially in parallel and extend vertically or substantially vertically when the outboard motor 10 is operated. The drive shafts 27*a*, 27*b* connect the motor shafts 25*a*, 25*b* and the propeller shafts 26*a*, 26*b*, and transfers rotational power from the motor shafts 25*a*, 25*b* to the propeller shafts 26*a*, 26*b*, e.g. through the bevel gears 28*a*, 28*b*. In the embodiment of FIG. 7 the first and second motor shafts 25*a*, 25*b* are arranged in parallel to the propeller shafts 26*a*, 26*b*.

All embodiments disclose an outboard motor 10. Hence, the motors 24*a*, 24*b*, the motor shafts 25*a*, 25*b*, the drive shafts 27*a*, 27*b* and the propeller shafts 26*a*, 26*b* are in a fixed configuration in relation to each other.

With reference to FIG. 8 another alternative embodiment is illustrated, wherein the first and second motors 24*a*, 24*b* are in lying positions similar to the embodiment of FIG. 6 and wherein the first power transfer arrangement includes a first endless loop flexible drive coupling 40*a*, and the second power transfer arrangement includes a second endless loop flexible drive coupling 40*b*. For example, the first and second endless loop flexible drive couplings 40*a*, 40*b* are arranged as one or more belts or one or more chains. For example, the first and second endless loop flexible drive couplings 40*a*, 40*b* are arranged as toothed belts. The first propeller shaft 26*a* is connected to the first motor shaft 24*a* through the first endless loop flexible drive coupling 40*a* to rotate the first propeller shaft 26*a* in a first direction, such as clockwise, for propelling the watercraft 11 in a forward direction. The second propeller shaft 26*b* is connected to the second motor shaft 24*b* through the second endless loop flexible drive coupling 40*b* to rotate the second propeller shaft 26*b* in a second direction opposite to the first direction, such as counter-clockwise, for propelling the watercraft 11 in a forward direction.

In the embodiment of FIG. 8 the first power transfer arrangement includes the first endless loop flexible drive coupling 40*a* and any other elements for transferring output power from the first motor shaft 25*a* to the first propeller shaft 26*a*, wherein the second power transfer arrangement includes the second endless loop flexible drive coupling 40*b* and any other elements for transferring output power from the second motor shaft 25*b* to the second propeller shaft 26*b*. Such other elements can optionally include pulleys, cogwheels and similar for use in combination with belts or chains in a conventional manner. In the illustrated embodiment, the first endless loop flexible drive coupling 40*a* is arranged separately from the second endless loop flexible drive coupling 40*b*, so that the first propeller shaft 26*a* is driven by means of only the first electric motor 24*a*, and the second propeller shaft 26*b* is driven by means of only the second electric motor 24*b*. The motor shafts 24*a*, 24*b* are arranged substantially in parallel to the propeller shafts 26*a*, 26*b*.

In the embodiment of FIG. 9, the first and second motor shafts 25*a*, 25*b* are arranged in parallel and extend in the same direction, such as aftward, in a similar manner as described with reference to FIG. 7. In the embodiment of FIG. 9 the first power transfer arrangement includes the first endless loop flexible drive coupling 40*a*, and the second power transfer arrangement includes the second endless loop flexible drive coupling 40*b* in a similar manner as described with reference to the embodiment of FIG. 8. Hence, in the embodiment of FIG. 9 the first endless loop flexible drive coupling 40*a* is longer then the second endless loop flexible drive coupling 40*b*. The first and second endless loop flexible drive couplings 40*a*, 40*b* are arranged in parallel or substantially in parallel and extend substantially perpendicular to the motor shafts 24*a*, 24*b* and the propeller shafts 26*a*, 26*b*. For example, legs of the first and second endless loop flexible drive couplings 40*a*, 40*b* extend vertically or substantially vertically when the outboard motor 10 is operated. In the embodiment of FIG. 8, the first endless loop flexible drive coupling 40*a* is arranged aftward of the second endless loop flexible drive coupling 40*b*. The motors 24*a*, 24*b*, the motor shafts 25*a*, 25*b*, the endless loop flexible drive couplings 40*a*, 40*b* and the propeller shafts 26*a*, 26*b* are in a fixed configuration in relation to each other.

The invention claimed is:

1. An outboard motor comprising a first propeller, a second propeller, a first propeller shaft and a second propeller shaft, wherein the second propeller shaft is arranged concentric with the first propeller shaft, wherein the first propeller shaft extends through the second propeller shaft and through the second propeller to the first propeller and wherein the first propeller shaft is connected to a first power transfer arrangement to rotate the first propeller shaft in a first direction, and wherein the second propeller shaft is connected to a second power transfer arrangement to rotate the second propeller shaft in a second direction opposite to the first direction, wherein the outboard motor comprises a first electric motor having a first motor shaft, and a second electric motor having a second motor shaft, wherein the first motor shaft is connected to the first power transfer arrangement, and wherein the second motor shaft is connected to the second power transfer arrangement.

2. The outboard motor according to claim 1, wherein the first motor shaft is arranged in parallel to the second motor shaft.

3. The outboard motor according to claim 1, wherein the first and second motors are arranged in a standing position in a power head of the outboard motor.

4. The outboard motor according to claim 1, wherein the first power transfer arrangement comprises a first drive shaft, and the second power transfer device comprises a second drive shaft.

5. The outboard motor according to claim 4, wherein the first drive shaft is arranged in parallel to the second drive shaft.

6. The outboard motor according to claim 4, wherein the first motor shaft is offset from the first drive shaft, and wherein the first motor shaft is connected to the first drive shaft through a first power transfer device.

7. The outboard motor according to claim 4, wherein the second motor shaft is offset from the second drive shaft, and wherein the second motor shaft is connected to the second drive shaft through a second power transfer device.

8. The outboard motor according to claim 4, wherein a distance between the drive shafts is smaller than a distance between the motor shafts.

9. The outboard motor according to claim 4, wherein the first drive shaft is connected to the first propeller shaft through a first bevel gear for transferring output power from the first drive shaft to the first propeller shaft in the first direction, and wherein the second drive shaft is connected to the second propeller shaft through a second bevel gear for transferring output power from the second drive shaft to the second propeller shaft in the opposite second direction.

10. The outboard motor according to claim 4, wherein the motor shafts and the drive shafts are arranged in a common vertical plane when said outboard motor is operated.

11. A watercraft comprising a hull and an outboard motor according to claim 1, wherein the first and second propeller shafts are arranged substantially horizontal and below the hull of the watercraft when said outboard motor is operated for propulsion of the watercraft.

12. A method for driving propeller shafts of an outboard motor, comprising the steps of a) driving a first motor shaft of a first electric motor in a first direction, and driving a second motor shaft of a second electric motor in a second direction opposite to the first direction, b) transferring rotational power from the first motor shaft to a first power transfer arrangement, and transferring rotational power from the second motor shaft to a second power transfer arrangement, and c) transferring rotational power from the first power transfer arrangement to a first propeller shaft connected to a first propeller and extending through a second propeller shaft and a second propeller to the first propeller, and transferring rotational power from the second power transfer arrangement to the second propeller shaft arranged concentric to the first propeller shaft, and thereby rotate the first and second propeller shafts in opposite directions.

13. The method of claim 12, comprising the steps of transferring the rotational power from the first motor shaft to a first drive shaft of the first power transfer arrangement, and transferring the rotational power from the second motor shaft to a second drive shaft of the second power transfer arrangement, and transferring the rotational power from the first motor shaft to the first drive shaft through a first power transfer device, so that a distance between the drive shafts is smaller than a distance between the motor shafts.

14. The method of claim 13, comprising the step of transferring the rotational power from the second motor shaft to the second drive shaft through a second power transfer device, so that the second drive shaft is offset from the second motor shaft.

15. The method of claim 13, comprising the step of transferring the rotational power from the first drive shaft to the first propeller shaft through a first bevel gear.

* * * * *